United States Patent [19]

Watanabe et al.

[11] Patent Number: 4,808,083

[45] Date of Patent: Feb. 28, 1989

[54] VARIABLE CAPACITY TYPE VANE COMPRESSOR

[75] Inventors: Yasushi Watanabe; Tatsuya Nakai; Shinichi Suzuki; Masahiro Kawaguchi, all of Kariya, Japan

[73] Assignee: Toyota Jidoshokki Seisakusho Kabushiki Kaisha, Aichi, Japan

[21] Appl. No.: 150,395

[22] Filed: Jan. 29, 1988

[30] Foreign Application Priority Data

Feb. 4, 1987 [JP] Japan ..... 62-015161[U]

[51] Int. Cl.[4] ..... F04B 49/02; F04C 29/08

[52] U.S. Cl. ..... 417/295; 417/310

[58] Field of Search ..... 417/295, 310, 440

[56] References Cited

U.S. PATENT DOCUMENTS 4,726,740 2/1988 Suzuki et al. ..... 417/295

FOREIGN PATENT DOCUMENTS 61-76792 4/1986 Japan .

*Primary Examiner*—William L. Freeh

*Attorney, Agent, or Firm*—Burgess, Ryan & Wayne

[57] ABSTRACT

A variable capacity type vane compressor comprising a cylinder having an oblong cylinder bore and a rotor with radial vanes rotatably inserted in the cylinder so that the radially outer ends of the vanes are in slidable contact with the cylinder bore surface to form compression chambers therebetween. A movable capacity control disk is arranged at an interface between one side plate and the rotor to control the quantity of introduced gas and/or returned compressed gas to vary a capacity of the compressor. The capacity control disk is moved by a spool actuator inserted in a spool cylinder having opposed working chambers. Gas under output pressure is introduced into the first working chamber, and oil under output pressure is introduced into the second working chamber, while a leak passage relieves the oil pressure to an intermediate pressure. A spring is also arranged in the second working chamber to urge the spool, and a valve is arranged in the oil passage close to the second working chamber to regulate the movement of the spool in response to a predetermined requirement.

12 Claims, 3 Drawing Sheets

VARIABLE CAPACITY TYPE VANE COMPRESSOR

BACKGROUND OF THE INVENTION

1. Field of the Invention

The present invention relates to a variable capacity type vane compressor comprising a cylinder having an oblong cylinder bore with a pair of side plates coupled on either side of the cylinder to close the cylinder bore, a rotor with a plurality of radially arranged vanes rotatably inserted in the cylinder to provide compression chambers in a space between the cylinder inner surface and the rotor outer surface, gas inlet means for introducing oil containing gas into the compression chambers, gas outlet means for discharging compressed gas from the compression chamber into an output chamber, and means for varying a ratio of the capacity of the compressor by bringing the compression chamber to a state where a full compression is not effected, and accordingly, the output capacity is decreased.

2. Description of the Related Art

A variable capacity type vane compressor is used in many applications, and in particular, for a compressor for compressing refrigerant gas in an air conditioning system in an automobile. A relatively large output capacity is required for such a compressor when the air conditioning system is operating in a high cooling mode to lower the temperature in the cabin of the automobile, but such a large output capacity may not be necessary when the air conditioning system is operating in a normal cooling mode to maintain a comfortable temperature once the temperature in the cabin has reached such a level. Therefore, at this time, desirably the capacity of the compressor is reduced.

Japanese Unexamined Patent Publication No. 61-76792, including the inventors of the present case, disclosed a variable capacity type vane compressor comprising a capacity control disk rotatably arranged at an interface between the front side plate and the cylinder/rotor and having an axially extending port (hereinafter second port). The front side plate has a first axially extending port for introducing gas to be compressed, which together with the second axially extending port of the capacity control disk, constitutes a continuous inlet passage for gas to be compressed. By rotational controlling the position of the capacity control disk, the flow area of the inlet passage can be varied to change the capacity of the compressor.

The actuator provided for moving the capacity control disk comprises a spool cylinder provided in the front side plate and a spool, to which the capacity control disk is connected, inserted in this spool cylinder for reciprocal movement. First and second working chambers are formed in the spool cylinder on opposite sides of the spool, and an oil passage connects the second working chamber to an oil separating chamber near the bottom thereof to introduce liquid oil under output pressure into the second working chamber. A valve is arranged in the oil passage and is operated by a change of the pressure of the inlet gas to open or close the oil passage; the pressure changes being caused by changes in the load of the refrigerating system. A leak passage connects the second working chamber to the inlet chamber to relieve the oil pressure in the second working chamber when the valve is closed.

The first working chamber is connected, via a narrow passage, to the vane inserting grooves in the rotor, which in turn are connected, via the bearing lubricating passage, to the oil separating chamber near the bottom thereof. Therefore, oil is delivered from the oil separating chamber under the output pressure but the pressure is released when oil passes through the vane inserting grooves and the bearing lubricating passage, and oil under an intermediate pressure is supplied to the first working chamber.

A problem occurs in this vane compressor in that oil in the first working chamber tends to flow back when the valve opens the oil passage and the oil under output pressure flows into the second working chamber. This causes an undesirably rapid motion of the spool and the capacity control disk and an abrupt change in the capacity of the compressor of from low to high. Also, when the valve closes the oil passage, oil in the second working chamber is relieved into the inlet chamber via the leak passage and the pressure in the second working chamber is decreased, causing an undesirably rapid motion of the spool and the capacity control disk and an abrupt change in the capacity of the compressor of from high to low. This induces an undesirable variation in the temperature of air in the evaporator in the system and reduces the air conditioning effect.

SUMMARY OF THE INVENTION

An object of the present invention is to provide a variable capacity type vane compressor which can solve the above described problems.

According to the present invention, there is provided a variable capacity type vane compressor comprising: an outer housing having housed therein a cylinder having a center axis and an inner surface to form an open-ended oblong cylinder bore and a pair of side plates coupled on either side of the cylinder to close the cylinder bore; a rotor rotatably inserted in the cylinder about the axis and having an outer surface to provide an annular space between the inner surface of the cylinder and the outer surface of the rotor, the rotor having a plurality of vanes arranged generally radially thereon and axially extending between the side plates so that the radially extended outer ends of the vanes are in slidable contact with the inner surface of the cylinder to divide the annular space into compression chambers and thereby compress the gas in that space upon rotation of the rotor; gas inlet means including means for forming an inlet chamber in the outer housing for oil-containing gas and means for forming an inlet passage for introducing gas from the inlet chamber into the annular space; gas outlet means including means for forming an outlet chamber in the outer housing and means for forming an outlet passage for discharging compressed gas from the annular space into the output chamber; means for forming an oil separating chamber in said outer housing in communication with said gas outlet means to separate liquid oil from oil containing gas and store same therein under an output pressure of the compressed gas; a movable capacity control disk arranged at an interface between one of the side plates and the rotor to control the quantity of gas introduced from the inlet chamber into the annular space, to control the quantity of compressed gas returned from the gas outlet means into the gas inlet means, or to control simultaneously the quantity of the introduced gas and returned gas to vary a capacity of the compressor; and actuator means for moving the capacity control disk.

More importantly, the actuator means comprises: means for forming a spool cylinder, a spool inserted in this spool cylinder for reciprocal movement and connected to the capacity control disk, first and second working chambers formed in the spool cylinder on opposite sides of the spool, first passage means connecting the first working chamber to the gas outlet means to introduce gas under output pressure into the first working chamber, a spring arranged in the second working chamber to urge the spool toward the first working chamber, second passage means connecting the second working chamber to the oil separating chamber to introduce liquid oil under that output pressure into the second working chamber, leak passage means connecting the second working chamber to the inlet chamber; and a valve means arranged in the second passage means to open or close the second passage means in response to a predetermined requirement.

With this arrangement, during the operation of the compressor, when the valve opens the second passage and oil under the output pressure in the oil separating chamber is introduced into the second working chamber, the spool is moved toward the first working chamber by the hydraulic pressure in the second working chamber and the force of the spring. In this case, gas under output pressure normally prevails in the first working chamber via the first passage, which serves as a damper; namely, gas in the first working chamber is temporarily compressed to a higher pressure and the spool is subjected to the reaction of the compression. Therefore, the spool is moved gradually toward the first working chamber and the capacity of the compressor is changed from low to high. The pressure in the second working chamber is relieved to an intermediate pressure by the provision of the leak passage while oil under output pressure is introduced into the second working chamber.

Then, when the valve closes the second passage while the compressor is operating at a high capacity, and oil from the oil separating chamber is shut off, the pressure in the second working chamber is gradually relieved via the leak passage, to a lower level. Thus the pressure of gas in the first working chamber urges the spool toward the second working chamber, against the force of the spring in the second working chamber, and therefore, the spool is moved gradually toward the second working chamber and the capacity of the compressor is changed from high to low.

BRIEF DESCRIPTION OF THE DRAWINGS

The present invention will become more apparent from the following description of the preferred embodiment with reference to the accompanying drawings, in which.

DESCRIPTION OF THE PREFERRED EMBODIMENTS

Figure 1:
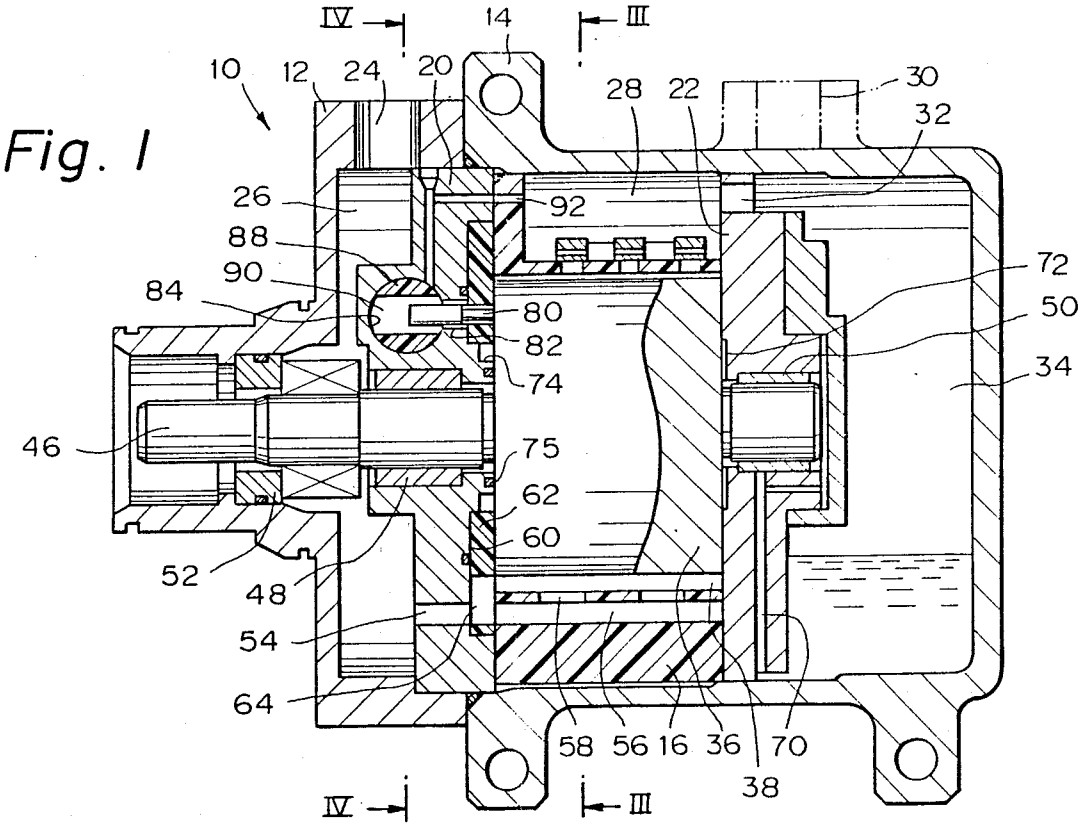
FIG. 1 is a sectional view of a variable capacity type vane compressor according to the present invention, taken along the line I—I in FIG. 3.

Referring to FIG. 1, the variable capacity type vane compressor 10 according to the present invention comprises an outer housing constituted by a front housing 12 and a rear housing 14 which are coupled together. A cylinder 16 has an oblong or elliptical bore 18 (FIG. 3), as is well known, and a front side plate 20 and a rear side plate 22 are coupled to the cylinder 16 on either side thereof to close the cylinder bore 18. This assembly is fixedly housed in the outer housing.

Figure 3:
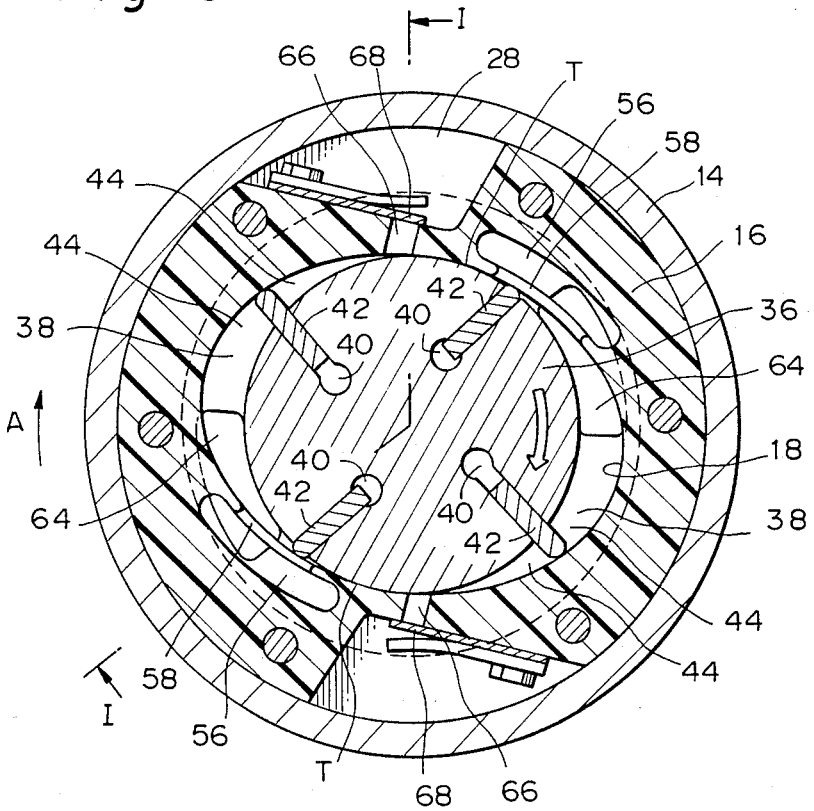
FIG. 3 is a sectional view of the compressor of FIG. 1, taken along the line III—III in FIG. 1.

The front housing 12 has an inlet 24 for gas to be compressed, in particular, refrigerant gas when the compressor 10 is used in an air conditioning system, at the outer shell thereof and an inlet chamber 26 formed therein and on the front side of the front side plate 20. The rear housing 14 has an outlet chamber 28 formed therein and outside of the cylinder 16 at a configured outer surface thereof (FIG. 3). The outlet chamber 28 is communicated with an outlet 30 via a passage 32 in the rear side plate 22. The rear housing 14 also forms an oil separating chamber 34 on the rear side of the rear side plate 22. Oil is contained in the gas to be compressed, in a mist, and will collect partly on the bottom of the oil separating chamber 34. The inlet 24 and outlet 30 are connected to a refrigerating system or an air conditioning system in an automobile.

Referring to FIGS. 1 and 3, a cylindrical rotor 36 is housed in the cylinder 16 and has a diameter generally corresponding to the short diameter of the elliptic cylinder bore 18, and thus a pair of diametrically opposite crescent-shaped spaces 38 are defined therebetween. The rotor 36 has a plurality (four in the illustrated embodiment) of vane inserting grooves 40 which extend radially outward and along the full length of the rotor 36. A vane 42 is slidably inserted in each of the grooves 40 so that the outer end of the vane 42 is in slidable contact with the inner surface of the cylinder 16 and divides the crescent-shaped spaces 38 into compression chambers 44.

As shown in FIG. 1, the front and rear side plates 20 and 22 have central bosses to receive a rotary shaft 46 through bearings 48 and 50, respectively. The rotary shaft 46 fixedly carries the rotor 36 and extends through the front housing 12 for connection to an outside drive means (not shown). A seal means, generally represented by the numeral 52, is provided between the front housing 12 and the rotary shaft 46 to seal the inlet chamber 26.

Figure 4:
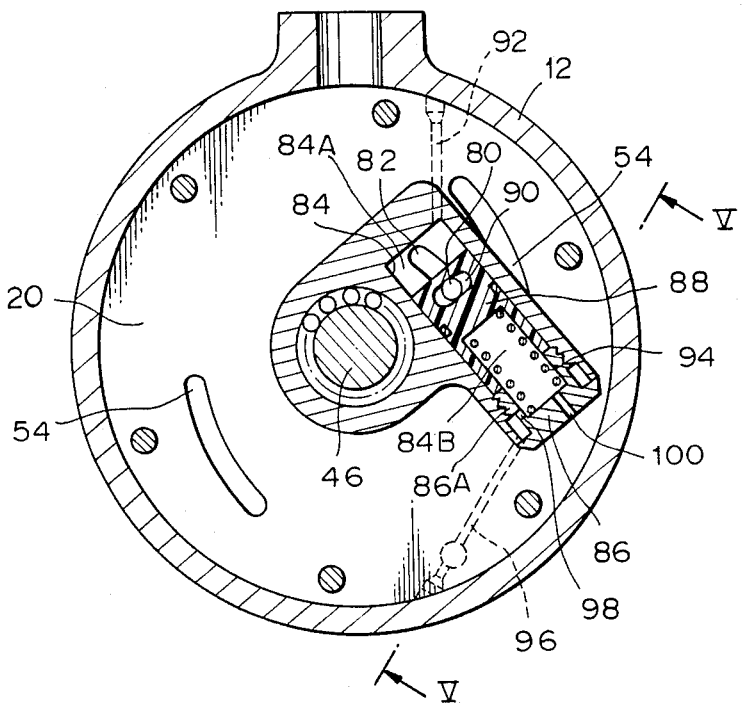
FIG. 4 is a sectional view of the compressor of FIG. 1, taken along the line IV—IV in FIG. 1.

As shown in FIGS. 1, 3 and 4, the front side plate 20 has a first pair of diametrically opposed and axially extending ports 54, which are arcuately shaped around the rotary shaft 46. Correspondingly, the cylinder 16 has a second pair of axially extending ports 56. The ports 54 and 56 are adapted to constitute a continuous inlet passage for introducing gas from the inlet chamber 26 into the compression chambers 44 of the space 38, with an intervention of a capacity control disk described later.

As shown in FIG. 3, the circumferential disposition of the ports 56 in the cylinder 16 is such that each of the ports 56 starts near a top position T where the outer surface of the rotor 36 is closest to the inner surface of the cylinder 16 and is circumferentially extended in the direction of the rotation of the rotor 36, represented by the arrow A. Inlet openings 58 extend radially inwardly in the cylinder 16, from the axially extending ports 56, into the inner surface of the cylinder 16.

Figure 2:
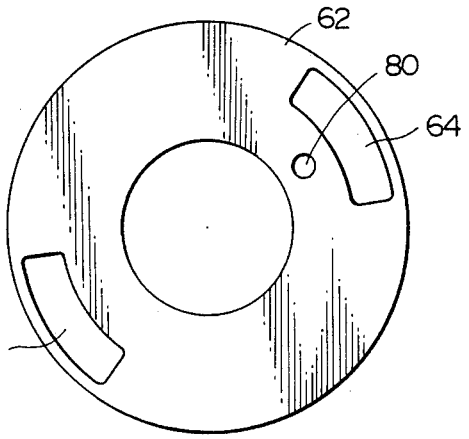
FIG. 2 is a front view of the capacity control disk in FIG. 1, viewed from the front side plate of the compressor.

The front side plate 20 has a ring-shaped recess 60 on the rear surface thereof and a capacity control disk 62 is rotatably fitted in the ring-shaped recess 60 to provide a surface coplanar with the rear surface of the front side plate 20. The capacity control disk 62 also has a pair of axially extending ports 64, as shown in FIGS. 1 and 2, which are also arcuate in shape but have a width greater, measured radially, than that of the ports 54 and 56 in the front side plate 20 and the cylinder 16; as shown in FIGS. 1 and 3. The radially outer peripheries of the ports 64 extend generally in line with those of the ports 54 and 56 but the inner peripheries of the former extend more inwardly than those of the latter and slightly beyond the inner surface of the cylinder 16 (partly visible in FIG. 3). Further, the ports 64 have a similar circumferential length to that of the ports 54 and 56, and thus overlap the ports 54 and 56 to constitute a continuous inlet passage but are shifted slightly in the circumferential direction from the latter. The overlap can be controlled by rotating the capacity control disk 62.

As shown in FIG. 3, outlet ports 66 are provided in the cylinder 16 at positions before the top position T, to connect the compression chambers 44 to the outlet chamber 28. Reed type check valves 68 are arranged on the outer opening of the outlet slots 66.

As shown in FIG. 1, the rear side plate 22 has an oil passage 70, which leads from the bottom of the oil separating chamber 34 to the rear bearing 50, and an annular oil passage 72 in the form of a recess in the front surface of the rear side plate 22 to communicate with the vane inserting grooves 40 (FIG. 3). Correspondingly, the front side plate 20 has an annular oil passage 74 at the rear surface thereof. Oil is forcibly supplied from the oil separating chamber 34, under the output pressure of the compressor, through the oil passage 70 to the rear bearing 50 to lubricate same and then supplied to the annular oil passage 72 to supply the oil to the vane inserting grooves 40 and to the opposite annular oil passage 74 to lubricate the sliding surfaces between each of the side plates 20, 22 and the rotor 36 with vanes 42. This oil also serves to lift the vanes 42 from the bottom of the vane inserting grooves 40 to achieve a good contact the inner surface of the cylinder 16. A seal ring 75 is arranged inside of the annular oil passage 74 of the front side plate 20, and thus oil can flow outwardly from the annular oil passage 74 to lubricate the capacity control disk 62.

Figure 5:
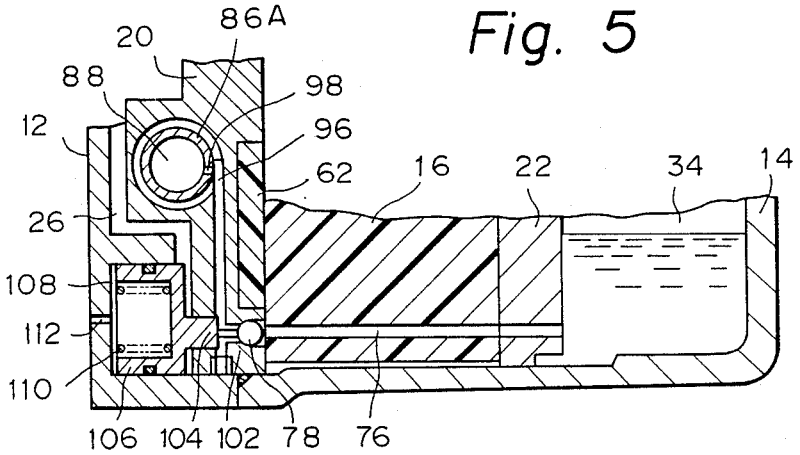
FIG. 5 is a sectional view of the compressor of FIG. 1, taken along the line V—V in FIG. 4.

As shown in FIG. 5, a second oil passage 76 is provided, which extends from the oil separating chamber 34 through the rear side plate 22 and the cylinder 16 to the front side plate 20, where a ball check valve 78 is arranged. The details thereof will be described later.

As shown in FIGS. 1, 2, and 4, the capacity control disk 62 has a pin 80 fixed on the front surface of the capacity control disk 62. The front side plate 20 has an arcuate slot 82 located radially inside of one of the arcuate ports 54 to allow passage of the pin 80 toward an actuator thereof.

The actuator comprises a spool cylinder 84 formed in the boss portion of the front side plate 20 and generally tangentially to the rotary shaft 46. The spool cylinder 84 is splined at one end thereof and is fitted at the other opening end with a plug 86. An actuator spool 88 is slidably inserted in the spool cylinder 84 for reciprocal movement and has an elongated slot 90 extending transversely of the spool 88 and generally radially of the front side plate 20. The pin 80 is engaged with this elongated slot 90 through an arcuate slot 82 of the front side plate 20. Accordingly, the reciprocal movement of the spool 88 can move the capacity control disk 62 rotationally reciprocally while the elongated slot 90 allows the pin 82 to move circumferentially.

Two working chambers 84A and 84B are formed in the spool cylinder 84 on either side of the spool 88. The upper of the working chambers, namely, the first working chamber 84A, is connected to the outlet chamber 28 through a passage 92, and thus the output high pressure is directly introduced into the first chamber 84A. A compression spring 94 is arranged in the second lower chamber 84B to urge the spool 88 upward toward the first chamber 84A. Also, the second chamber 84B is connected to a passage 96, which is connected to the oil separating chamber 34 through the above stated oil passage 76. In the illustrated embodiment, the plug 86 has a leg portion 86A extending within the spool cylinder 84 to receive the spool 88 when the spool 88 is urged downward and an annular space is provided between the leg portion 86A and the inner wall of the spool cylinder 84 at a part of or near the threadable engaging area (see FIG. 5). The oil passage 96 is extended in the front side plate 20 and is open to that annular space and the second chamber 84B via a slot 98.

A restricted leak passage 100 is provided in the plug 86 to allow oil in the second chamber 84B to slowly escape to the inlet chamber 26. Note, the pressure of oil supplied from the oil separating chamber 34 is a high pressure corresponding to the pressure of the output gas in the outlet chamber 28 and is relieved in the second chamber 84B to an intermediate pressure between the inlet pressure and outlet pressure. The resultant pressure of the spring 94 and the intermediate pressure becomes greater than the pressure in the first working chamber 84A, to thereby urge the control piston 88 upward.

As shown in FIG. 5, a valve seat 102 is provided in the oil passage 76 to receive the ball check valve 78 so that the valve 78 engages with the valve seat 102 under the pressure from the oil separating chamber 34 to close the oil passage 76. A pusher member 104 is arranged to push the valve 78 to open the oil passage 76. The pusher member 104 is integrally constituted with a pusher piston 106, which is slidably inserted in a pusher cylinder 108 formed in the wall of the inlet chamber 26 so that one of the opposite surfaces of the pusher piston 106 is open to the inlet gas in the inlet chamber 26, and thus the pusher piston 106 can be retracted from the valve 78. A spring 110 is arranged to urge the pusher piston 106 from the opposite surface thereof, to advance the pusher piston 106 toward the valve 78. A vent hole 112 is provided in the pusher cylinder 108.

The operation of the compressor according to the illustrated embodiment is now described.

In the case of an automotive air conditioning system, the pressure of gas at the inlet of the compressor 10 will vary in accordance with the load in the system; the pressure may become relatively high when the cooling requirement is high (and thus a high capacity of the compressor is required), and alternatively, may become relatively low when the low cooling requirement is low (and thus a low capacity is required). Therefore, the pusher piston 106 with the pusher member 104 will operate automatically in accordance with the cooling requirement to advance the pusher member 104 to open the valve 78 when the inlet pressure is lower than the force of the spring 110, and to retract the pusher member 104 to close the valve 78 when the inlet pressure is higher than the force of the spring 110.

When the valve 78 opens the oil passage 76, 96, oil under the output pressure is introduced from the oil separating chamber 34 into the second working chamber 84B of the actuator. The pressure of oil will be decreased from the leak passage 100 to an intermediate pressure but the resultant intermediate pressure and the force of the spring 94 may become higher than the pressure of output gas in the first working chamber 84A, so that the spool 88 will be pushed toward the first working chamber 84A. Accordingly, the capacity control disk 62 is moved in the clockwise direction in FIG. 3 (in the anticlockwise direction in FIG. 4).

As will be appreciated, the turning of the capacity control disk 62 in the clockwise direction in FIG. 3 means that the axially extending ports 64 is moved circumferentially relative to the axially extending ports 54 and 56, and thus the extent of the overlap of the ports is changed to reduce or restrict the flow area of the inlet gas passage. Therefore, the capacity of the compressor becomes lower.

In the typical vane type compressor, the compression stroke starts when the vane 42 passes through the trailing edge of the inlet opening 58 of the inlet passage constituted by ports 54, 64 and 56, and ends when the vane 42 reaches the outlet opening 66. However, in the illustrated embodiment, the start of the compression stroke is slightly delayed, due to the axially extending ports 64 which can directly open into the annular spaces 38, or compression chambers 44, bypassing the ports 56, since it extends radially inwardly relative to the inner surface of the cylinder 16, as will be clear from FIG. 1. Therefore, the compression stroke starts when the vane 42 passes through the trailing edge of the opening of the axially extending ports 64 of the capacity control disk 62; this can also mean that the compression stroke starts when the vane 42 passes through the inlet opening 58 and once-compressed gas is returned to the axially extending port 64 until the vane 42 covers the port 64. This also causes a lower capacity of the compressor.

In this circumstance, gas under the output pressure in the first working chamber is temporarily compressed, resisting the movement of the spool 88, and serves as a damper. Therefore, the spool 88 moves gradually toward the first working chamber 84A and the capacity of the compressor 10 is changed from low to high.

Conversely, when the valve 78 closes the oil passage 76, 96, oil in the second working chamber 84B leaks into the inlet chamber 26 through the leak passage 100, resulting in a gradual decrease in the pressure in the second working chamber 84B. Therefore, the pressure of gas in the first working chamber 84A may become higher than the resultant pressure of oil in the second working chamber 84B and the force of the spring 94, so that the spool 88 will move toward the second working chamber 84B, rotating the capacity control disk 62 in a direction reverse to the above described low capacity case. Then the flow area of inlet gas passage is increased and the quantity of returned compressed gas is minimized, and thus a high capacity of the compressor is achieved. In this case, the restriction of the leak passage 100 and spring 94 absorbs the rapid motion of the spool 88. The annular clearance between the spool cylinder 84 and the spool 88 also serves to damp the motion of the spool 88 since it allows leakage of gas in the first working chamber 84A through the second working chamber 84B rather than a leakage of oil, and thereby the applied pressure is felt gradually.

Considering the case where the compressor 10 is connected to an engine of the automobile (not shown) via a solenoid operated clutch (not shown) and the compressor 10 remains inactive for a considerable time, the pressure in the inlet chamber 26 may be higher than the force of the spring 94, so that the pusher member 104 is in the retracted position and the valve 78 closes the oil passage 76, but the pressure may become equal throughout the entire space in the compressor 10 over a long term stoppage. The spool 88 thus may be urged toward the first working chamber 84A by the force of the spring 94, and therefore, the capacity control disk 62 maintains the compressor 10 in the low capacity state.

Accordingly, the compressor 10 can be started in the low capacity state by connecting the clutch, with a result that less load is imposed on the engine and less torque shock is felt upon start up. After the compressor 10 is started, the low capacity operation may continue for a short time until the output pressure reaches a predetermined level. Note, in this regard, the output pressure is introduced in the first working chamber 84A of the actuator while the inlet pressure is introduced in the first working chamber 84B via the leak passage 100, since the valve 78 remains closed. Therefore, the compressor 10 starts the compression work gradually and then effects the compression work with a high capacity when the output pressure becomes high enough to move the spool 88 toward the second working chamber 84B against the spring 94, to achieve a rapid cooling.

The temperature in the cabin may be lowered to a comfortable level by the high capacity operation, but then the cooling load requirement will drop and the pressure of inlet gas for the compressor 10 decreased to a predetermined level under which the pusher 104 advances to open the valve 78. Therefore, oil under the output pressure is introduced into the second working chamber 84B and the compressor 10 is changed gradually and without overshoot from the high capacity state to the low capacity state.

The spool 88 can be located between the highest and lowest capacity positions when the gas output pressure and the oil pressure plus spring force are in balance.

The invention is described above with reference to only one embodiment, but the invention is not limited to this illustrated embodiment, and it is possible to make various modifications without departing from the spirit of the present invention. For example, the capacity was controlled by mainly controlling the flow area of the inlet gas, but it is possible to mainly control the return or bypass of the once-compressed gas through the capacity control disk 62 and the front side plate 20 or only through the capacity control disk 62. Also, any control means can be provided in the capacity control disk 62 other than the axially extending port 64, for example, a wing or the like member. Further, the actuator spool cylinder 84 and the spool 88 can be located in the cylinder 16.

We claim:

1. A variable capacity type vane compressor comprising:

an outer housing having housed therein a cylinder having a center axis and an inner surface to form an open-ended oblong cylinder bore and a pair of side plates coupled on either end of said cylinder to close said cylinder bore;

a rotor rotatably inserted in said cylinder about said axis and having an outer surface to provide an annular space between the inner surface of said cylinder and the outer surface of said rotor, said rotor having a plurality of vanes arranged generally radially thereon and axially extending between said side plates so that the radially outer ends of said vanes are in slidable contact with the inner surface of said cylinder to divide said annular space into compression chambers and thereby effect a compression of gas in said space upon rotation of said rotor;

gas inlet means including means for forming an inlet chamber in said outer housing for oil-containing gas and means for forming an inlet passage for introducing gas from said inlet chamber into said annular space;

gas outlet means including means for forming an outlet chamber in said outer housing and means for forming an outlet passage for discharging compressed gas from said annular space into said output chamber;

a means for forming an oil separating chamber in said outer housing in communication with said gas outlet means to separate liquid oil from oil containing gas and store same therein under an output pressure of the compressed gas;

a movable capacity control disk arranged at an interface between one of said side plates and said rotor to control a quantity of gas introduced from said inlet chamber into said annular space, or to control a quantity of compressed gas returned from said gas outlet means into said gas inlet means, or to control simultaneously the quantity of said introduced gas and returned gas to vary a capacity of the compressor; and actuator means for moving said capacity control disk;

said actuator means comprising;

means for forming a spool cylinder;

a spool inserted in said spool cylinder for reciprocal movement and connected to said capacity control disk;

a first and a second working chambers formed in said spool cylinder on opposite sides of said spool;

first passage means connecting said first working chamber to said gas outlet means to introduce gas under output pressure into said first working chamber;

a spring arranged in said second working chamber to urge said spool toward said first working chamber;

second passage means connecting said second working chamber to said oil separating chamber to introduce liquid oil therein;

leak passage means connecting said second working chamber to said inlet chamber; and a valve means arranged in said second passage means to open or close said second passage means in response to a predetermined requirement.

2. A compressor according to claim 1, wherein said one of the side plates has a ring-shaped recess on an inner side surface thereof about said axis and said capacity control disk is correspondingly ring-shaped and rotatably fitted in said ring-shaped recess to provide, together with said inner side surface of said one of the side plates, a coplanar inner side surface facing a side surface of said rotor.

3. A compressor according to claim 2, wherein said spool cylinder is formed in said one of the side plates.

4. A compressor according to claim 3, wherein said capacity control disk has a pin fixed on a surface thereof opposite to said coplanar inner side surface to engage with said spool of said actuator means and said one of the side plates has a slot to allow said pin to extend toward said spool cylinder.

5. A compressor according to claim 4, wherein said slot is formed in an arcuate shape in cross-section, formed by an arc of a circle about said axis.

6. A compressor according to claim 5, wherein said relatively restricted leak passage means connects said second working chamber to said inlet chamber.

7. A compressor according to claim 6, wherein said valve means comprises a valve element and an associated valve seat arranged in said second passage means so that said valve element is caused to rest on said valve seat by the pressure of oil from said oil separating chamber to close said second passage means, and a pusher member is provided to engage with said valve element to release said valve element from said valve seat to open said second passage means.

8. A compressor according to claim 7, wherein said pusher member has one side receiving pressure in said inlet chamber and an opposite side urged by a spring so that said pusher member can push said valve element in response to the pressure level in said inlet chamber.

9. A compressor according to claim 1, wherein each of said one of the side plates, said capacity control disk and said cylinder has at least one axially extending inlet port, successively overlapping, to form a continuous inlet passage for said oil-containing gas, and said cylinder having at least one opening extending radially inwardly from said at least one axially extending inlet port into the inner wall of said cylinder.

10. A compressor according to claim 9, wherein said capacity control disk can be rotated about said axis to regulate the extent of overlap of said at least one axially extending inlet port to at least control the quantity of gas introduced from said inlet chamber into said annular space.

11. A compressor according to claim 9, wherein said at least one axially extending inlet port of said capacity control disk is so shaped and arranged that a portion thereof opens into said annular space of said cylinder at a position advanced from said inlet opening of said cylinder in view of the rotation of the rotor, to thereby constitute a bypass allowing compressed gas during the compression stroke in the compressor to return from said compression chamber to said gas inlet passage.

12. A compressor according to claim 10, wherein said at least one axially extending inlet port of said capacity control disk is so shaped and arranged that a portion thereof opens directly into said annular space of said cylinder at a position advanced from said inlet opening of said cylinder in view of the rotation of the rotor, to thereby constitute a bypass allowing compressed gas during the compression stroke in the compressor to return from said compression chamber to said gas inlet passage.

* * * * *